United States Patent [19]

Lazaro, Jr.

[11] 4,443,936

[45] Apr. 24, 1984

[54] CONTACT CRIMPER AND METHOD OF USING

[75] Inventor: Luis J. Lazaro, Jr., Seattle, Wash.

[73] Assignee: The Boeing Company, Seattle, Wash.

[21] Appl. No.: 322,302

[22] PCT Filed: Sep. 30, 1981

[86] PCT No.: PCT/US81/01320

§ 371 Date: Sep. 30, 1981

§ 102(e) Date: Sep. 30, 1981

[87] PCT Pub. No.: WO83/01347

PCT Pub. Date: Apr. 14, 1983

[51] Int. Cl.[3] ..... H01R 43/04

[52] U.S. Cl. ..... 29/863; 29/753; 29/748

[58] Field of Search ..... 29/753, 715, 863, 748

[56] References Cited

U.S. PATENT DOCUMENTS

| | | | |
|---|---|---|---|
| 3,664,173 | 5/1972 | Haucke et al. | 29/753 X |
| 4,178,679 | 12/1979 | Lichtenstein | 29/753 X |
| 4,232,443 | 11/1980 | Lichtenstein et al. | 29/753 |
| 4,348,806 | 9/1982 | Eves et al. | 29/753 X |

*Primary Examiner*—Howard N. Goldberg
*Assistant Examiner*—Carl J. Arbes
*Attorney, Agent, or Firm*—Morris A. Case; B. A. Donahue

[57] ABSTRACT

A contact is bulk fed into the side of a guide block where it is raised up into a crimping head. A sectioned funnel guides wire ends into the positioned contact, after which the sections move apart to permit bottoming of the wires in the contact, and then the contact is crimped to the wire.

8 Claims, 15 Drawing Figures

Fig. 1
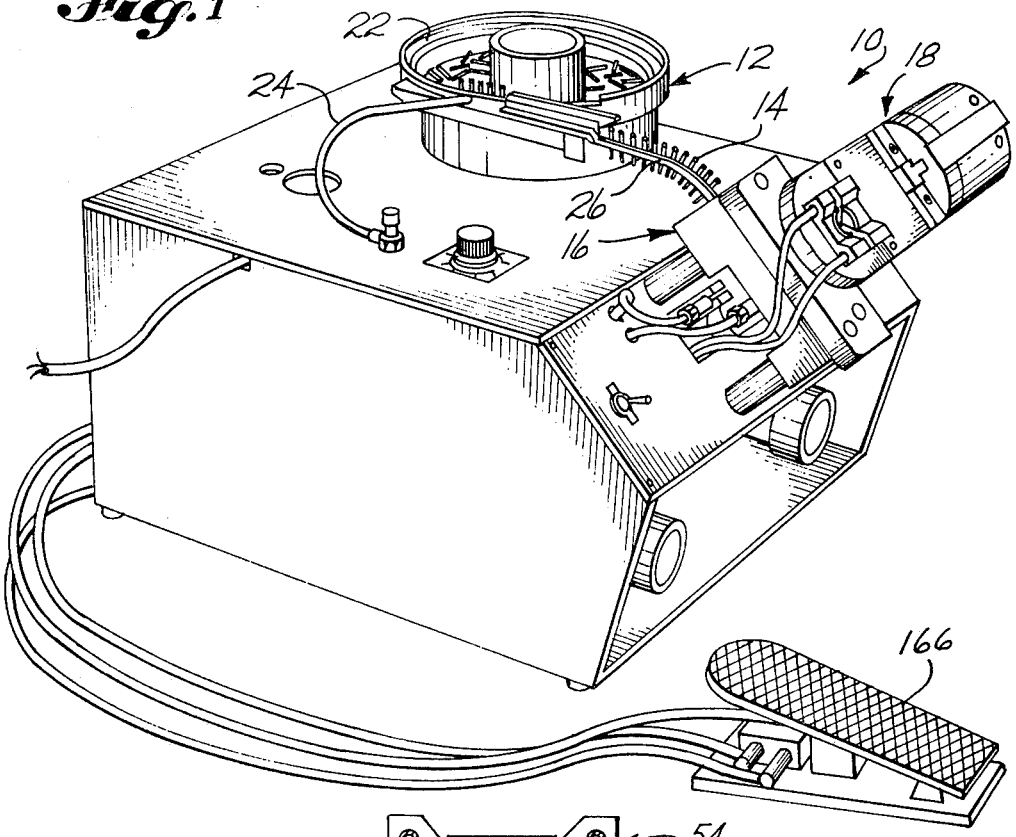
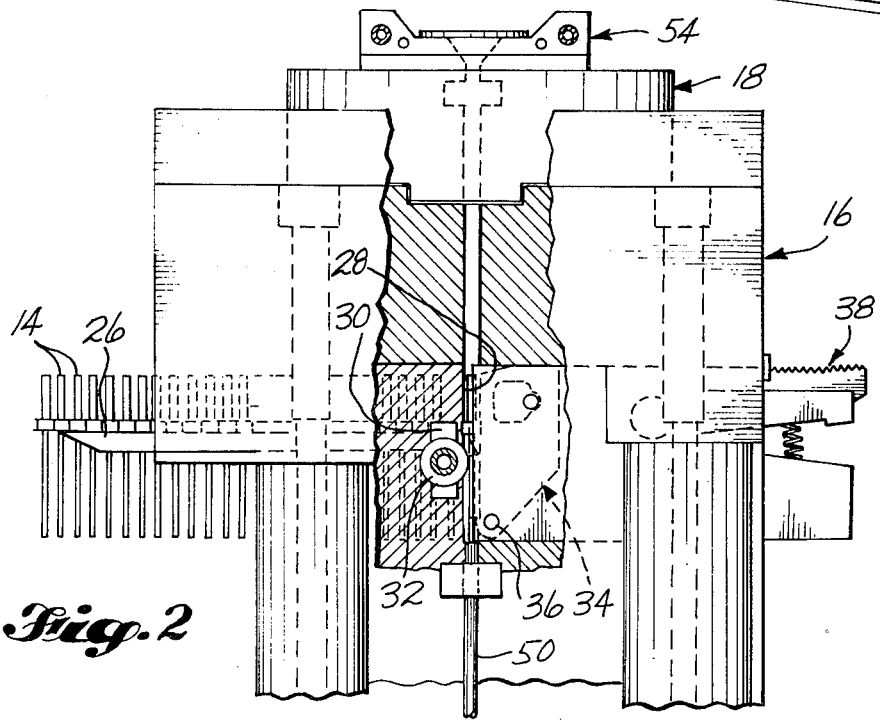
Fig. 2

Fig. 11
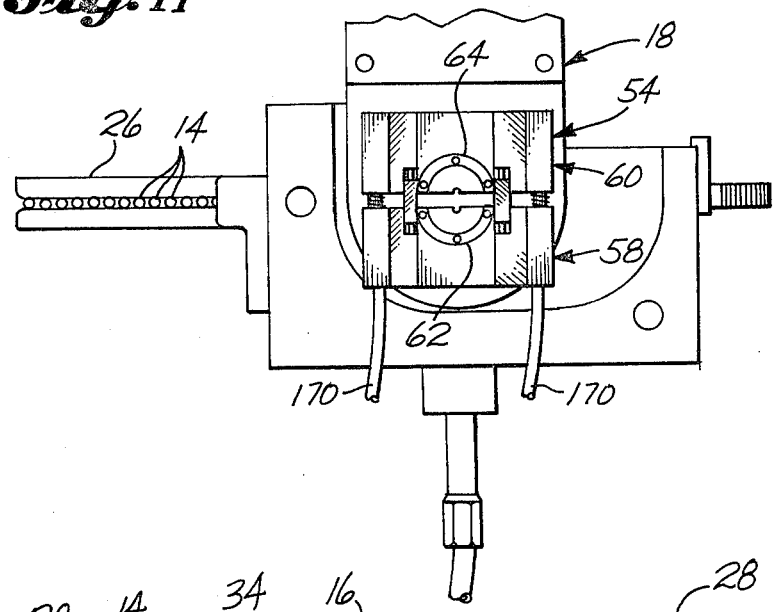
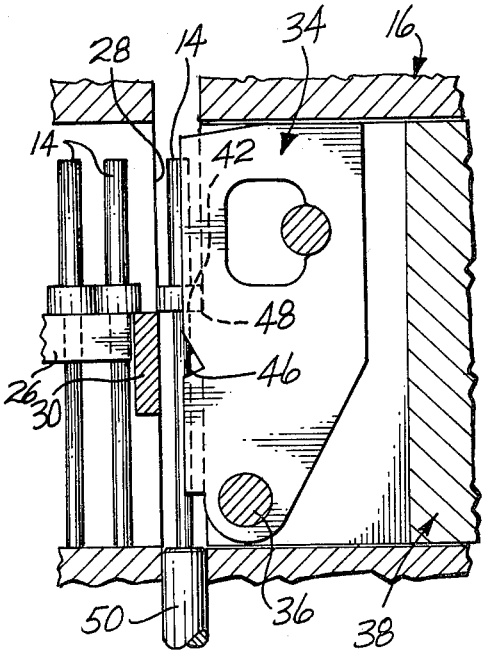
Fig. 5
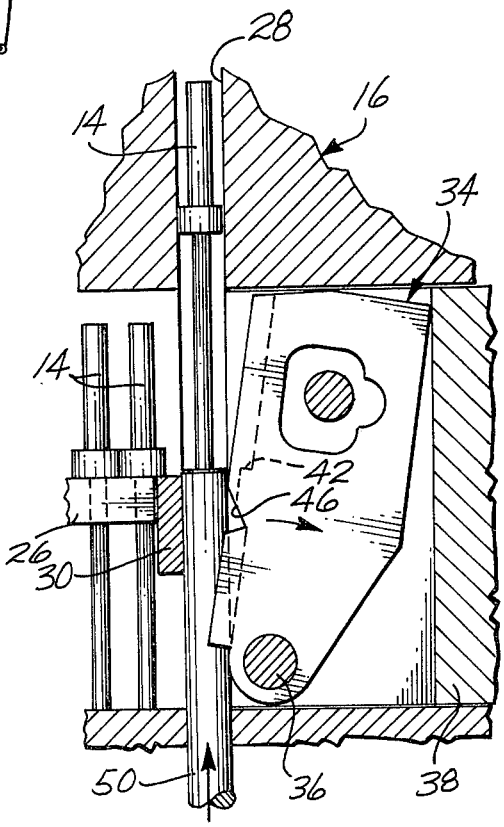
Fig. 6

CONTACT CRIMPER AND METHOD OF USING

BACKGROUND OF THE INVENTION

One of the better ways of attaching a wire end to a pin on a socket type of contact is by crimping the contact to the wire. In some operations the contacts are individually joined to a feed belt, however a preferred method from a cost standpoint utilizes a vibratory bowl type of feeder where the contacts are placed in a bowl which is vibrated to bulk feed the contacts.

The size of the contacts may present a problem when the connectors are small. This often presents difficulty in ensuring all the wire ends enter the contact, instead of separating to leave some of the wires outside. The small contacts are also easily bent which can present problems in automatic handling.

SUMMARY OF THE INVENTION

A vibratory bulk feed bowl automatically feeds contacts onto a track where the line of contacts are introduced one at a time into a reference hole in a guide block. A crimper is mounted above and in alignment with the reference hole. The contact in the reference hole is held in alignment by a means that is moved aside in response to a plunger that raises and holds the contact up into the crimper. A sectioned funnel mounted above the crimper guides wire ends into the contact after which the sections move apart to permit bottoming of the wire in the contact immediately before they are crimped together.

It is an object of this invention to provide an apparatus for crimping an automatically fed contact to a wire end.

It is another object of this invention to positively feed wire ends into a small size contact.

It is yet another object of this invention to keep small size contacts properly aligned during an automatic feed contact and wire crimping process.

DESCRIPTION OF THE DRAWINGS

FIG. 1 shows a perspective view of the crimping device of this invention.

FIG. 2 is a fragmented end elevational view of the crimper with a contact aligned in a guide block.

FIG. 5 shows a fragmented blown up sectional view, as in FIG. 2, of the contact.

FIG. 6 shows the view of FIG. 5 with the contact being raised.

FIG. 11 shows a fragmented plan view of the crimping unit.

DETAILED DESCRIPTION

Figure 3:
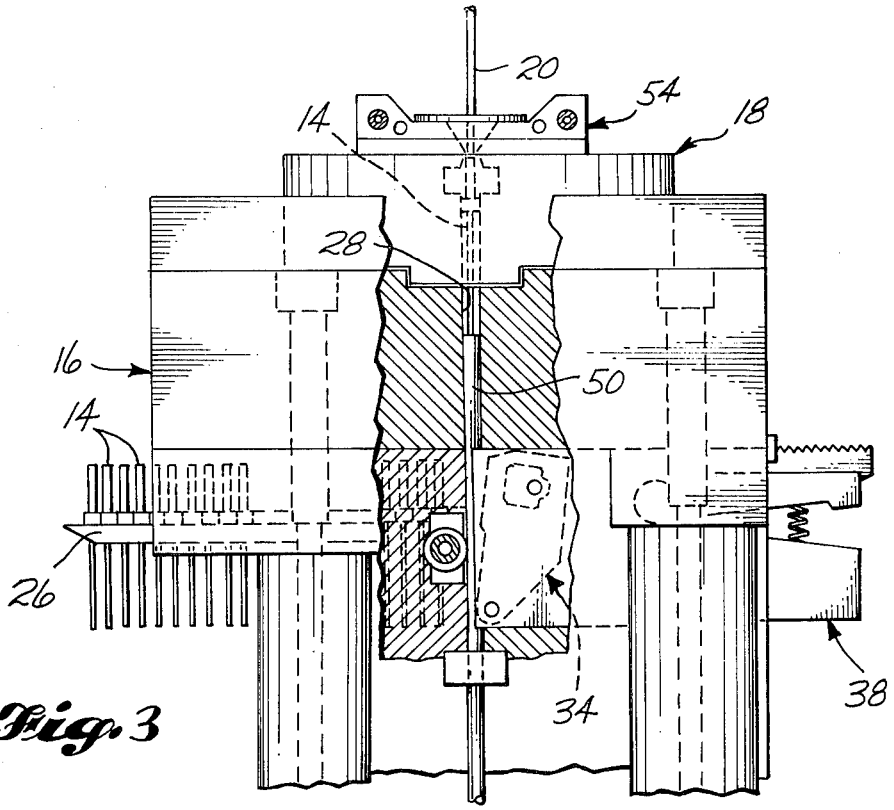
FIG. 3 is a fragmented end elevational view as in FIG. 2, but with the contact raised into the crimper head.
Figure 4:
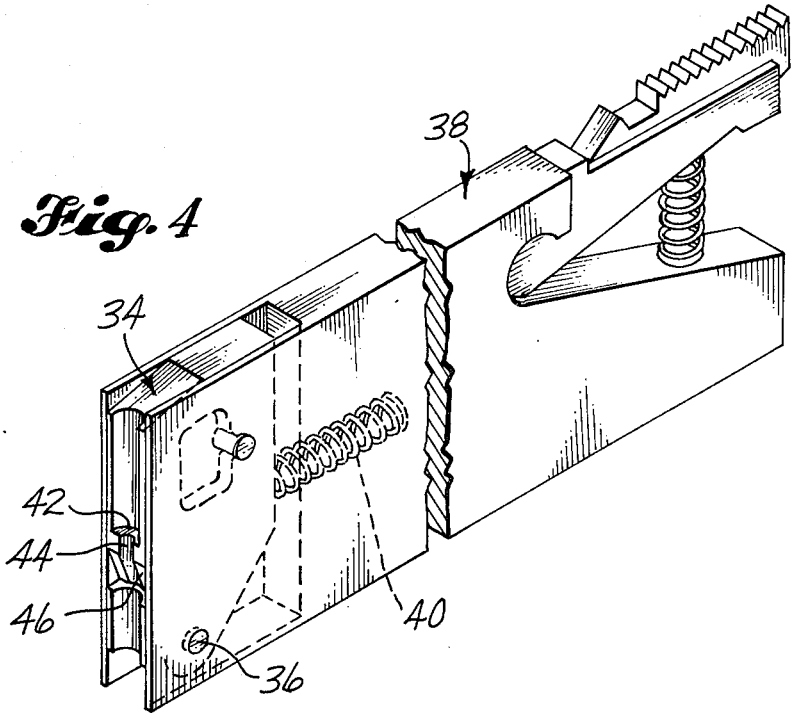
FIG. 4 shows a perspective view of a snap-out plug used in this invention.

A crimping device 10 has a bulk feed vibratory bowl 12, for directing electrical contacts 14, into a guide block 16, where the contacts are raised up into a crimper 18, for joining to a wire end 20. The contacts are placed in the bowl, and vibration of the bowl moves the contacts up and onto a track 22. An air line 24 is located with outlet at the top of the bowl to blow those contacts that are not properly aligned back into the bowl. The contacts that are properly aligned transfer onto guide rails 26 where they are moved in line down the inclined plane of the rails and terminate inside the guide block at alignment opening or reference hole 28. The continuous feeding in combination with the inclined guide rails mean the consecutive contacts maintain a continuous feeding movement with the last contact located in the alignment opening in the guide block. A shaped gate 30, controlled by an air actuator cylinder 32 acts to hold back all the contacts, during part of the crimping cycle, other than the contact positioned in the alignment hole. The positioned contact is held in proper alignment upon entering the reference hole by abutting against a support member 34; which is pivotally mounted at 36, to a snap-out plug 38. The support member is resiliently held in position by a spring 40; which holds the member in position but also allows the member to be pivoted aside to clear the alignment hole 28. The support member has a projection with a flat top surface 42, with a recess 44, shaped to be axially aligned in the alignment hole, and an inclined surface 46. The flat top surface acts as a support to a shoulder 48 on the contact 14, the contact fits in the recess, and the inclined plane is acted against by a plunger 50 to provide the means for moving the support member aside to clear the alignment hole. The plunger is sized to fill the alignment hole 28 and is mounted to move reciprocally within the hole to push the aligned contact up into the crimper. Plunger movement is controlled by a pneumatic cylinder 52.

Figure 12:
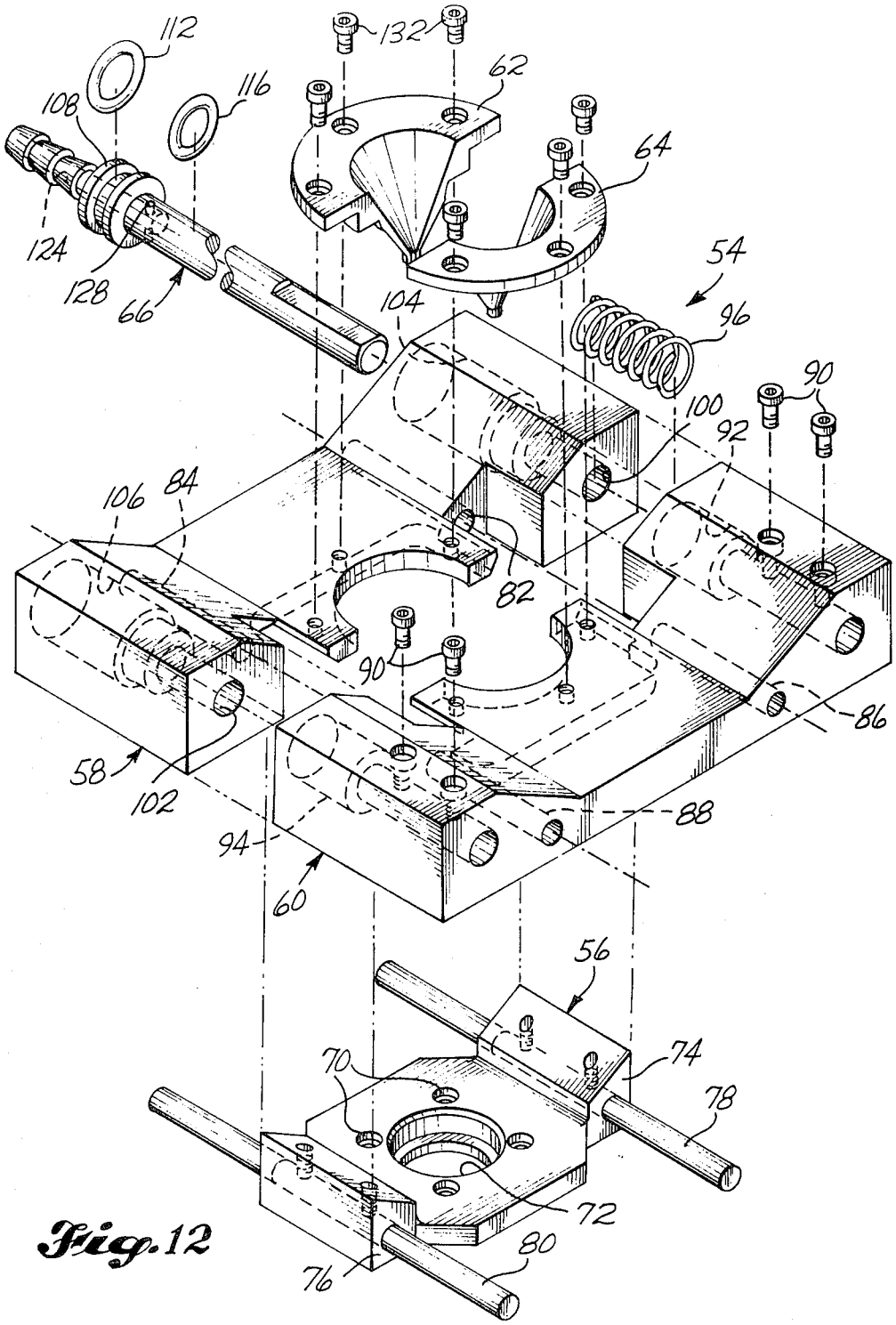
FIG. 12 shows an exploded perspective view of a sectionized funnel used with this invention.
Figure 13:
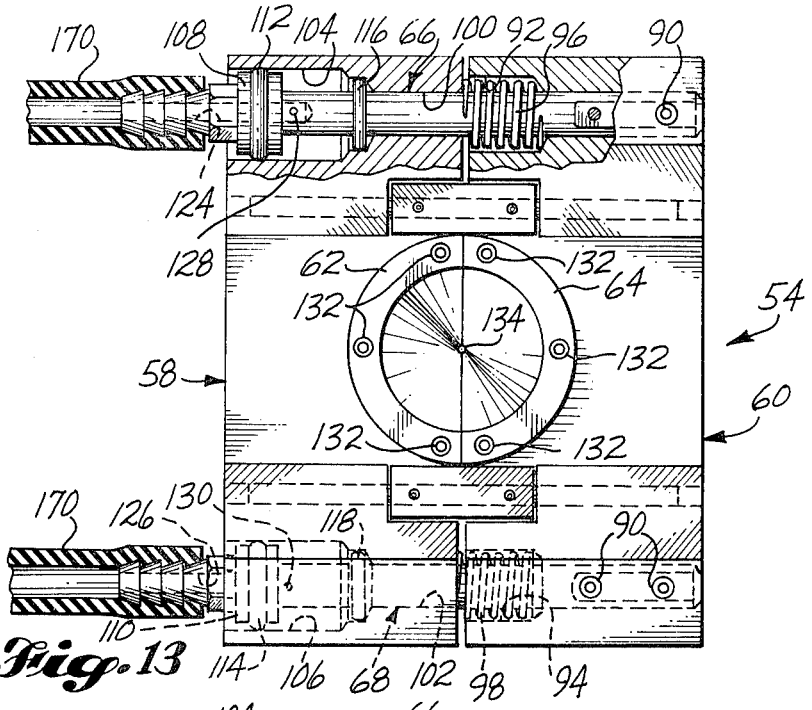
FIG. 13 shows a plan view of the funnel of FIG. 12 with the funnel sections together.
Figure 14:
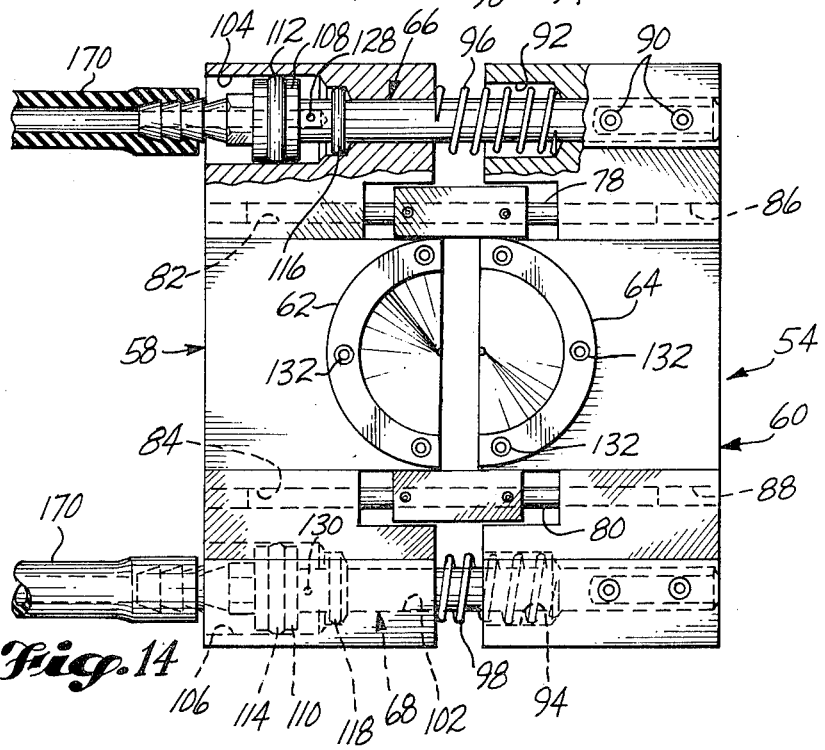
FIG. 14 shows a plan view as in FIG. 13 but with the funnel sections moved apart.

A funnel 54 is mounted above the crimper head 18, and is in axial alignment with the reference hole 28 in the guide block. The funnel, as best shown in FIGS. 12 through 14, has a base 56, movable sections 58 and 60, funnel guide sections 62 and 64, and rods 66 and 68. The base has holes 70 to permit mounting the base to the crimper head and an opening 72 to permit access to the crimper and the reference hole 28 in the guide block. The base also has projections 74 and 76 each of which has an opening for rigidly mounting parallel pins 78 and 80 that extend past the projection and permit entry into openings 82 and 84 in movable funnel section 58, and openings 86 and 88 in movable section 60. The openings are sized to provide a slip fit to the pins to permit the sections to move upon the pins. The rods 66 and 68 are mounted to the movable sections in a manner to be parallel to the pins with the rod ends extending into and mounted to section 60 with fasteners 90. There is an enlarged concentric recess 92 and 94 in the section and compression springs 96 and 98 fit in the recess and around the rod. The springs are longer than the recess is deep to continually press the movable sections apart.

The rods extend through the first section 58, and have a slip fit in opening 100 and 102. There is an enlarged recess 104 and 106 in the first movable members that are concentric with the rods. The recess is located in the part away from the second movable members. The rods have pistons 108 and 110 located in the area of the recesses 104 and 106, O-ring seals 112 and 114 between the parts of the piston, and O-ring seals 116 and 118 each mounted around a rod and located in the bottom of the recess to in combination make up cylinders 120 and 122. The rods each have an axially located hole 124 and 126 extending in from one end and an access hole 128 and 130 to permit the introduction of air into the recess 104 and 106 between the O-rings to move the rods and act against the springs 96 and 98 to move the two movable sections together. Funnel guide sections 62 and 64 are mounted to the movable members with fasteners 132. These guide sections when brought together are cone shaped and have a concentric opening 134 at the bottom for guiding a wire.

Figure 7:
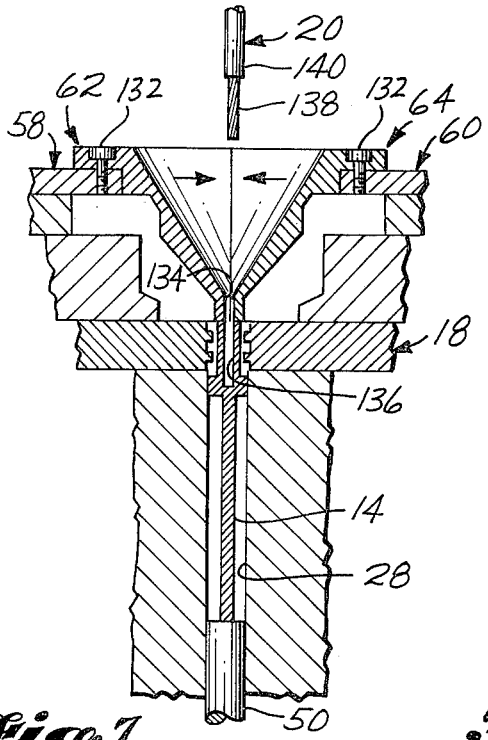
FIG. 7 shows a fragmented blown up view as in FIG. 3 with the contact into the crimper head.
Figure 8:
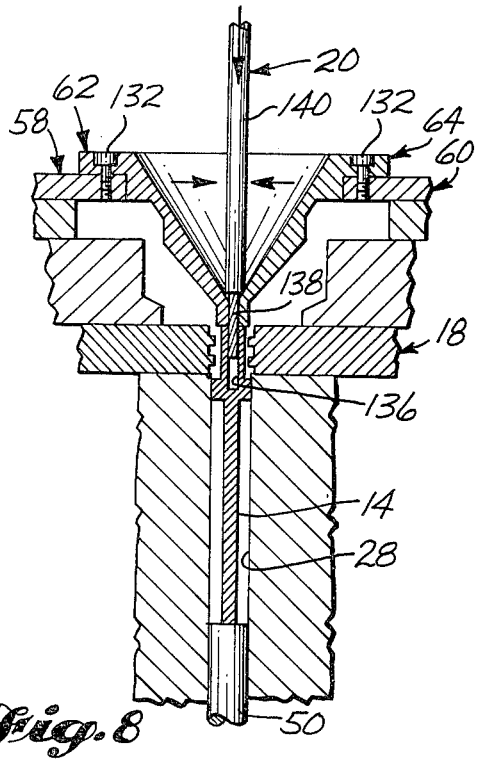
FIG. 8 shows a view as in FIG. 7 with a wire end inserted in the contact.
Figure 9:
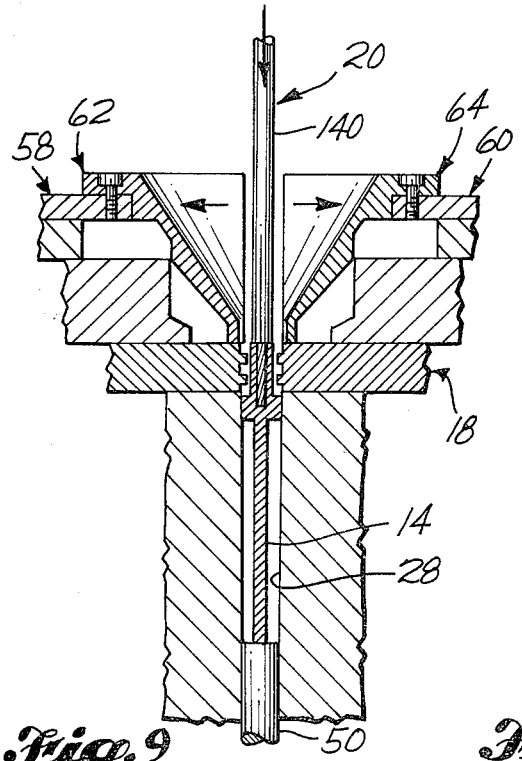
FIG. 9 shows the view as in FIG. 8 with the inserted wire end bottomed out in the contact.
Figure 10:
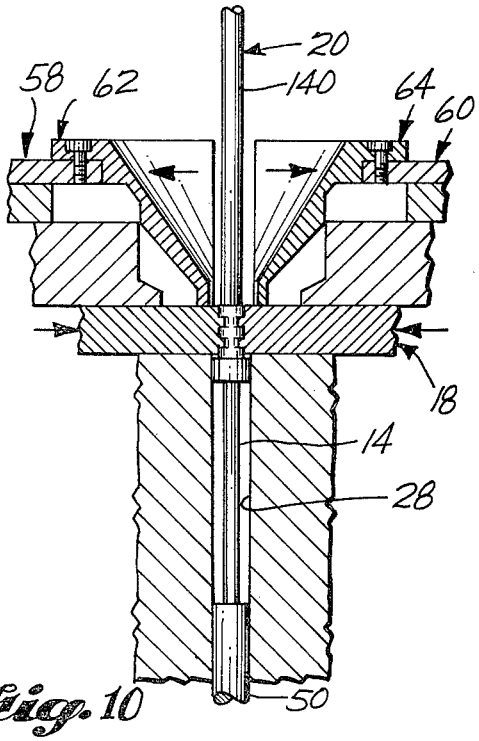
FIG. 10 shows the view as in FIG. 9 with the contact crimped to the wire.

FIGS. 7 through 10 show the sequencing of the funnel when crimping. In each of those views a contact 14 is shown being held by the plunger 50, in reference hole 28, and in the crimper 18. In FIG. 7 the sections of the funnel are together and are aligned for guiding a wire end 20 into a barrel 136 of a contact. The wire end has wires 138 and covering insulation 140. In FIG. 8 the wires have been inserted into the barrel of the contact with all of the wires 138 directed into that barrel. The insulation being of a larger diameter is stopped by the sides of the funnel. In FIG. 9 the sections of the funnel have been moved apart, the wire end bottomed out in the contact, and the insulation is resting against the end of the contact. FIG. 10 shows the bottomed out wire being crimped to the contact.

Figure 15:
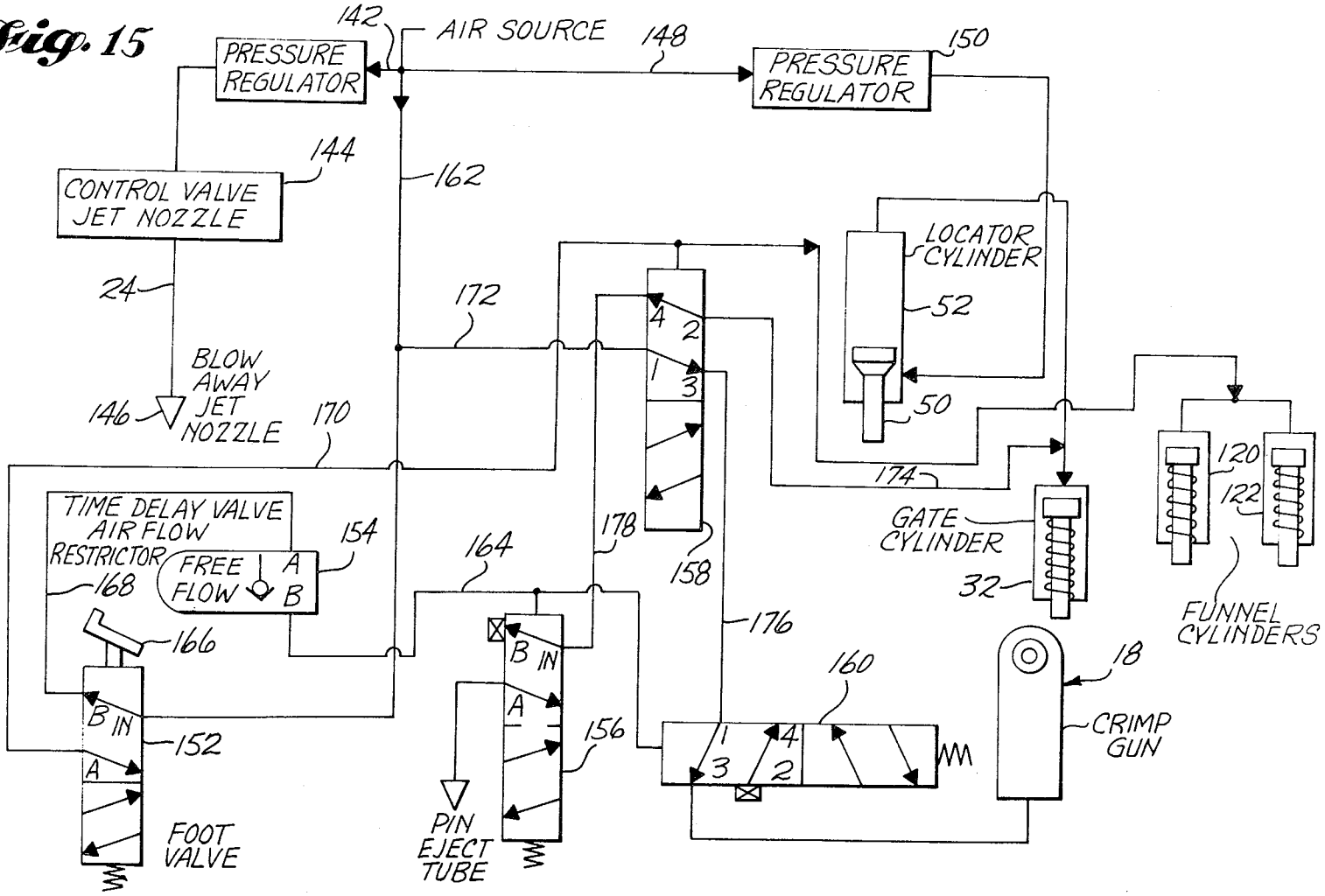
FIG. 15 shows a schematic of the controls for the crimping device of this invention.

FIG. 15 shows a schematic of the air system for controlling the invention. Compressed air from a source not shown passes through line 142, control valve 144, line 24 and nozzle 146 where it blows any contacts 14 that are not properly aligned back into the bowl 12. Air also is directed through line 148 into pressure regulator 150, thence into an end of pneumatic cylinder 52. The sequencing is controlled by five valves 152, 154, 156, 158, and 160. As air enters through line 162 it passes through valves 152 and 154, and then through line 164 where it actuates valves 156 and 160. When the foot pedal 166 for valve 152 is depressed it exhausts air from line 168 through valve 152, and at the same time it introduces air through line 170 to activate valve 158, and funnel cylinders 120 and 122. When valve 158 is activated it introduces air from line 172 through the valve then through line 174 to actuate gate cylinder 32 and locator cylinder 52. The air pressure from the pressure regulator 150 is lower than the pressure in line 174; so the gate cylinder actuates before the locator cylinder is actuated. When the foot pedal is released, valve 152 is reversed to exhaust line 170 to deactivate the funnel cyinders and open up the funnel sections, and to deactivate valve 158. When that valve is deactivated it permits compressed air to pass from line 172 through valve 158, line 176 and valve 160 to actuate the crimper head. Time delay valve 154 permits a delayed buildup in pressure line 164; which opens valve 156 to exhaust air from 178 to permit the gate cylinder and the locator cylinder to return to starting position, and to close valve 160 to close the crimper head.

In operation, contacts 14 are placed in the vibratory bowl 12, and the machine turned on to feed contacts to the guide block 16. The foot pedal 166 is depressed to actuate gate cylinder 32, and to then actuate the locator cylinder 52 with plunger 50 to raise the positioned contact up into the crimper, and to bring sections of the funnel 54 together. Next, wires 138 are inserted into the contact through the funnel, the foot pedal released, the wire bottomed in the contact, the contact crimped to the wires, the wire end with contact removed, and the plunger returned to starting position. Exhaust air, from the cylinder controlling the plunger, is directed up into the alignment hole of the guide block to blow out any crimped contact that is not connected to a wire end.

I claim:

1. A method of crimping a contact to a wire end, with steps comprising: feeding a line of contacts into an alignment hole in a guide block, holding a positioned contact with a shaped end of a snap-out plug, moving the end of the plug aside while raising the contact up into a crimper head, inserting a wire end through a guiding funnel into the contact, opening the funnel and bottoming the wire in the contact, and crimping the contact to the wire.

2. A method of crimping a contact to a wire end, with steps comprising: feeding a line of contacts into an alignment hole in a guide block, providing resilient alignment support as the contact reaches the alignment hole, and moving the resilient alignment support aside as the contact raises in the alignment hole, raising the aligned contact in the alignment hole up into a crimper head, inserting a wire end through a guiding funnel into the contact, opening the funnel and bottoming the wire in the contact, and crimping the contact to the wire.

3. An apparatus for crimping a contact to a wire end comprising: means located on a support means for automatically feeding a succession of wire contacts to a reference hole in a guide block, a crimping device on the support means aligned over the reference hole, a plunger axially aligned in the reference hole and means for reciprocally moving the plunger, a multi sectional funnel located over the crimper to axially align all wires of a wire end into a barrel of the contact, means located above said crimper for opening the funnel to bottom the wire end in the barrel before crimping the contact to the wire end, resilient means located in the guide block for aligning the contact in the reference hole, means located below the guide block for moving the resilient aligning means aside as the plunger moves the contact up into position, and means operably located for sequencing all the devices to crimp the wire ends into the contacts.

4. An apparatus for crimping a contact to a wire as in claim 3 wherein the resilient means for aligning the contact comprises a pivotally mounted part formed to abut against the side of and to support the contact, and a resilient member holding the pivotally mounted part in position and mounted to allow the part to pivot out of the reference hole as the plunger is raised.

5. An apparatus for crimping a contact to a wire end comprising: means located in a support means for automatically feeding a succession of wire contacts to a reference hole in a guide block, a crimping device on the support means axially aligned over the reference hole, a plunger aligned in the reference hole, means for actuating the plunger to move upward and place the aligned contact up into the crimper, a snap-out plug in the guide block and located to abut the contact when in the reference hole, with the plug having resilient means acting to hold a pivotally mounted abutting end against the contact with the end shaped to hold the contact and to be moved aside by the plunger as it moves upward to raise the contact, a funnel split into two parts and axially aligned over the crimper, means located above the crimper for moving the parts of the funnel together to permit insertion of all wires of a wire end into a barrel of the contact and for moving the parts of the funnel apart to permit bottoming of the wire end in the contact, means located in the guide block for actuating the crimper to join the bottomed wire to the contact, and means operably located for sequencing all the devices.

6. An apparatus for crimping a contact to a wire as in claim 5 wherein the means for moving the funnel parts comprises: a pair of parallel rods each having a slip fit through a first part of the funnel and joined to a second part and each rod having compression means in the second part for resiliently forcing the two members apart, and piston means in the first part to overcome the compression means and to pull the two parts together.

7. An apparatus for crimping a contact to a wire as in claim 6 wherein the compression means comprises a recess around the rod in the second part and adjacent the first part, and a compression spring in that recess that extends outside the recess; and the piston means comprises: a recess in the first part at the side away from the second part, a piston around the rod in that recess with the piston having a seal and a second seal around the rod and at the bottom of the recess; and means for introducing a fluid under pressure through the rod and into the space between the seals.

8. An apparatus for crimping a contact to a wire end comprising: means located in a support means for automatically feeding a succession of wire contacts to a reference hole in a guide block, a crimping device on the support means axially aligned over the reference hole, a plunger sized to fill the cross section of and to reciprocally move in the reference hole, a snap-out plug in the guide block having an end abutting against and shaped to hold a contact aligned in the reference hole, with the shaped end resiliently mounted to be pushed aside as the plunger moves the contact upward, means for raising the plunger for placing the contact in the crimper, a multi sectional funnel mounted above and aligned with the crimper to guide all wires of a wire end into a barrel of the contact, sequencing means operably located for opening the funnel to permit bottoming of the wire in the contact prior to crimping and to withdrawal of the plunger, and means operably located for sequencing all the devices to accomplish crimping the contact to the wire end.

* * * * *